US006926486B1

(12) United States Patent
Kooser et al.

(10) Patent No.: US 6,926,486 B1
(45) Date of Patent: Aug. 9, 2005

(54) MICRO ADJUSTING SEAMING LEVER

(75) Inventors: Timothy J. Kooser, Newbury, OH (US); Joseph F. Ball, Stow, OH (US)

(73) Assignee: Pneumatic Scale Corporation, Cuyahoga Falls, OH (US)

( * ) Notice: Subject to any disclaimer, the term of this patent is extended or adjusted under 35 U.S.C. 154(b) by 91 days.

(21) Appl. No.: 10/247,250

(22) Filed: Sep. 19, 2002

Related U.S. Application Data

(60) Provisional application No. 60/323,614, filed on Sep. 19, 2001.

(51) Int. Cl.[7] ..... B21D 51/32
(52) U.S. Cl. ..... 413/1; 413/27; 413/72
(58) Field of Search ..... 413/27–40, 1, 413/72, 74; 53/334, 340

(56) References Cited

U.S. PATENT DOCUMENTS 2,540,001 A * 1/1951 Laxo ..... 413/31
3,465,703 A * 9/1969 Arnott et al. ..... 413/30
5,149,239 A * 9/1992 Honma et al. ..... 413/31
5,358,369 A * 10/1994 Katou et al. ..... 413/27

FOREIGN PATENT DOCUMENTS

JP 60170543 A * 9/1985 ..... B21D 51/32

* cited by examiner

*Primary Examiner*—Allen Ostrager
*Assistant Examiner*—Jimmy Nguyen
(74) *Attorney, Agent, or Firm*—Nancy L. Reeves; Walker & Jocke

(57) ABSTRACT

A seaming lever containing a micro adjusting seaming element. When used in a seaming lever, the micro adjusting element permits both a coarse and a fine adjustment of the position of the seaming roll with respect to the chuck. This micro adjusting element may be retrofitted into any existing seaming lever which uses a worm gear for rotational adjustment of the seaming roll. It may also be incorporated as a design element of newly manufactured seaming levers.

19 Claims, 9 Drawing Sheets

MICRO ADJUSTING SEAMING LEVER

This application claims the benefit of Provisional Application No. 60/323,614, filed Sep. 19, 2001.

TECHNICAL FIELD

This invention generally relates to seaming levers. Specifically, this invention relates to a micro adjusting seaming lever containing an adjusting worm which may be used to precisely position a seaming roll in relation to a chuck, in order to use the seaming roll and chuck to create a can seam.

BACKGROUND ART

Canning machines are known in the prior art. One type of machine used in commercial canning secures an end to a can body after the product has been placed in the can by formation of a folded double seam. An example of a double seam forming machine which secures top ends to can bodies is shown in U.S. Pat. No. 3,465,703. The disclosure of this patent is incorporated herein by reference. A second example is shown in the published PCT Application No. PCT/US97/14471 which was filed on Aug. 18, 1997. The disclosure of this Application is incorporated herein by reference.

During the process of using a commercial canning device to close a can, a seaming roll must be initially positioned with respect to a cooperating chuck. The relationship of the seaming roll to the chuck must be precise in order to make a proper seam.

One method of positioning the seaming roll is to use a seaming lever which houses a worm gear. This is used in conjunction with a worm pinion which is formed on one end of a shank. The worm pinion end of the shank is connected to a seaming lever and the other end of the shank is connected to a seaming roll lever. The seaming roll lever is attached to the seaming roll, which is used with the chuck to create the seam. The worm gear in the seaming lever engages the worm pinion on the shank. Turning the worm gear in one direction rotates the shank around its axis in one direction, moving the seaming roll either closer to or farther away from the chuck. Rotating the worm gear in the opposite direction will rotate the shank in the opposite direction, thus moving the seaming roll in the opposite direction.

Generally, the seaming roll position determines the final thickness of the can seam. Its precise placement is difficult to achieve using the current design because rotating the worm gear produces relatively large rotations of the shank used to control the position of the seaming roll. A worm gear associated with a 30 tooth worm pinion, typical for this manufacturing use, would create a 12 degree rotation of the associated shank for every 360° rotation of the worm gear. Although this is an impressive reduction, it still provides insufficient control to precisely position the seaming roll.

Further refinement of the worm gear and worm pinion can create marginal, but not sufficient, additional reduction. In part this is because any additional reduction comes at the price of structural integrity. Very fine, closely packed threads and teeth produce large reductions. Unfortunately threads and teeth which produce sufficient reduction for precise placement may not be sturdy enough to withstand the rigors of a manufacturing environment. In addition, creating additional reduction by using a finer worm gear creates a new problem by eliminating the ability to make larger rotations of the shank easily.

Thus, there exists a need for an adjustable seaming lever which has dual adjustment capabilities, a coarse adjustment with reduction which approximates the rotational reduction of a standard worm gear and a fine adjustment which produces far greater rotational reduction. There further exists a need for this adjusting apparatus to be sturdy, in order to withstand the forces to which it is subjected during the canning process.

DISCLOSURE OF INVENTION

It is an object of an exemplary form of the present invention to provide an apparatus which is capable of making minute rotational adjustments to an associated shank.

It is a further object of an exemplary form of the present invention to provide an apparatus that is capable of making dual adjustments, specifically an initial coarse rotational adjustment, followed by a precise, fine rotational adjustment.

It is a further object of an exemplary form of the present invention to provide a dual rotational adjustment apparatus which is capable of withstanding the forces associated with a typical manufacturing processes.

It is a further object of an exemplary form of the present invention to provide a seaming lever which incorporates a dual rotational adjustment apparatus.

It is a further object of an exemplary form of the present invention to provide a dual rotational adjustment apparatus which can be retrofitted into existing seaming levers without requiring that the existing seaming lever be remachined.

It is a further object of an exemplary form of the present invention to provide a seaming lever in which it is possible to preselect the desired reduction to be produced by the fine adjustment feature.

Further objects of an exemplary form of the present invention will be made apparent in the following Best Modes for Carrying Out Invention and the appended claims.

The foregoing objects are accomplished in an exemplary embodiment of the invention by a micro adjusting seaming lever that uses either rotational or axial motion of a worm gear alone for coarse adjustment, and which mechanically combines rotational and axial motion of a worm gear for fine adjustment.

An exemplary adjustment apparatus of one exemplary embodiment fits into a standard seaming lever and may comprise three parts. The first is a shank with a worm pinion on one end and a seaming roll lever on the other. The second is a coarse adjusting nut which can rotate within a cavity in the seaming lever, but does not otherwise move. The third is an adjusting worm which can both rotate and move along its axis. An adjusting worm of this exemplary embodiment, is threaded on one end and has a worm gear on the other. The threaded end of the adjusting worm is referred to herein as a screw. The coarse adjusting nut is threaded onto the screw of the adjusting worm and engages a worm pinion on the shank.

As noted, in this exemplary embodiment the coarse adjusting nut can rotate but cannot move axially. Because of this, when the coarse adjusting nut is turned about the screw on the adjusting worm, it moves the adjusting worm into or out of the seaming lever along the axis of the adjusting worm. As the adjusting worm moves in or out of the seaming lever, the worm gear acts as a rack, turning the worm pinion on the shank which also turns the connected seaming roll.

Once the seaming roll is approximately positioned relative to the chuck, the coarse adjusting nut is locked in place to prevent any further motion.

After the coarse adjusting nut is locked in place, the adjusting worm is turned to precisely position the seaming roll. As the screw of the adjusting worm rotates within the fixed coarse adjusting nut, it moves the adjusting worm in the opposite axial direction that it had moved when the coarse adjusting nut was turned in the same direction. Acting alone, this motion would also cause the worm gear to act as a rack, turning the associated worm pinion in the opposite direction.

In addition, as the adjusting worm turns, the worm gear also rotates. The rotational motion of the worm gear, acting alone, would cause the associated worm pinion to rotate in the opposite direction from the rotation caused by the rack action of the worm gear. Because the axial motion and the rotational motion would each independently create opposite rotations of the worm pinion, the mechanical combination of the two creates a rotation of the worm pinion which is equal in magnitude to the difference between the rotations each motion would produce independently. The direction of the motion corresponds to the direction associated with the independent resulting rotation of larger magnitude. As will be discussed in detail later, the magnitude of the resulting motion is a function of the difference between the pitches of the threads on the worm gear and of the screw on the adjusting worm. In exemplary embodiments this magnitude may be made quite small by making the pitch of the worm gear threads differ only slightly from the pitch of the screw threads.

Because of this, both the worm gear and the screw can be made with sufficiently wide threads and with a pitch that is appropriate for use in manufacturing without sacrificing the ability to make microscale adjustments. Because an adjusting worm of this exemplary embodiment uses the axial motion to produce coarse adjustments and the combination of axial and rotational motion to create fine adjustments, the feature produces dual adjustment capabilities. Another exemplary embodiment, described in detail below, uses rotational motion to make the initial coarse adjustment and then uses the same differential reduction principles to combine the axial and rotational motions to make the subsequent fine adjustment.

BEST MODES FOR CARRYING OUT INVENTION

Figure 1:
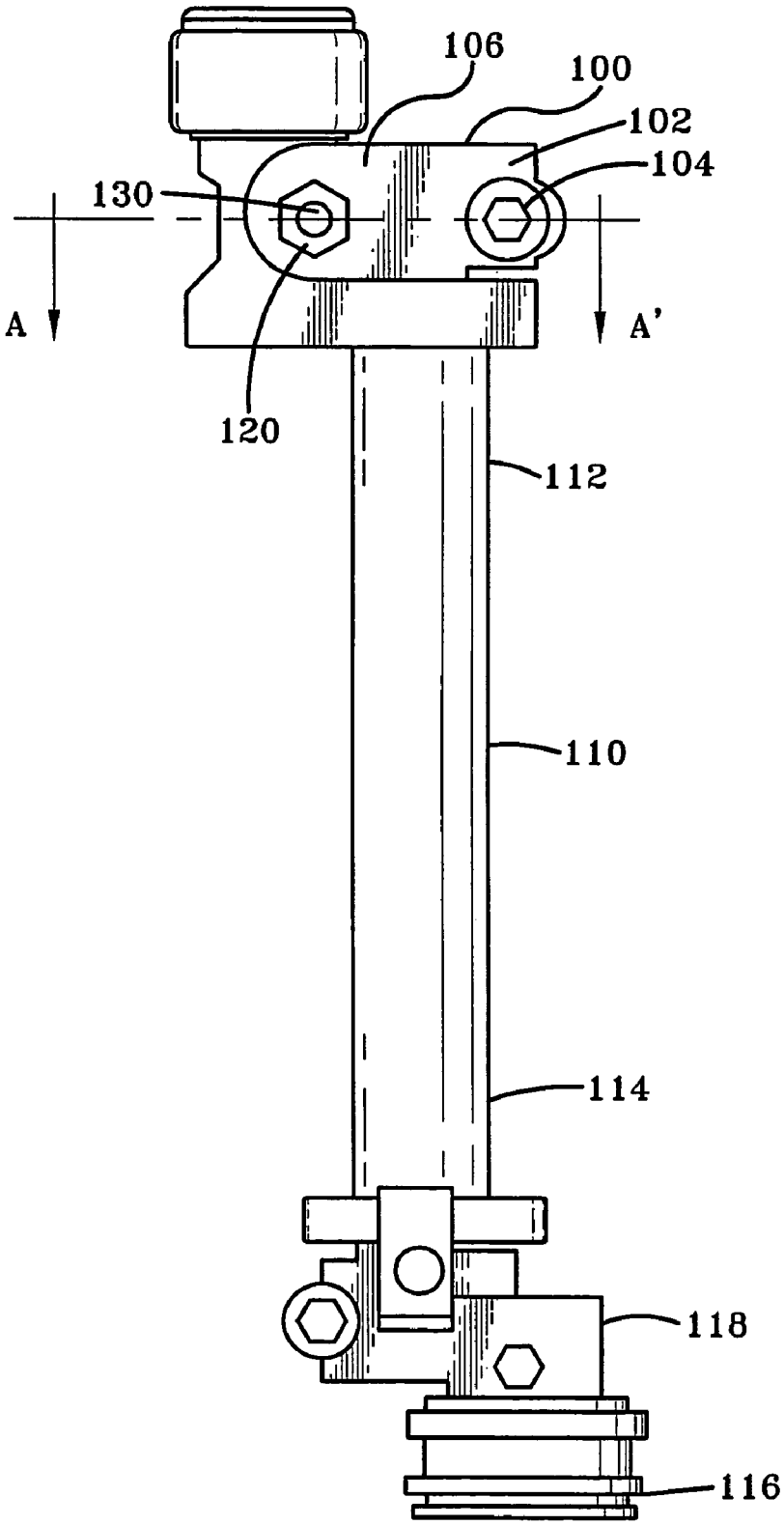
FIG. 1 is a side plan view of an exemplary embodiment of a seaming lever and the associated shank, seaming roll lever, and seaming roll.

Referring now to the drawings, in particular to FIG. 1, there is shown therein an exemplary embodiment of a micro adjusting seaming lever generally referred to by reference numeral 100. In the exemplary embodiment the seaming lever attaches to a shank 110 which rotates axially to adjust the distance between a seaming roll 116 and a chuck (not shown).

Figure 2:
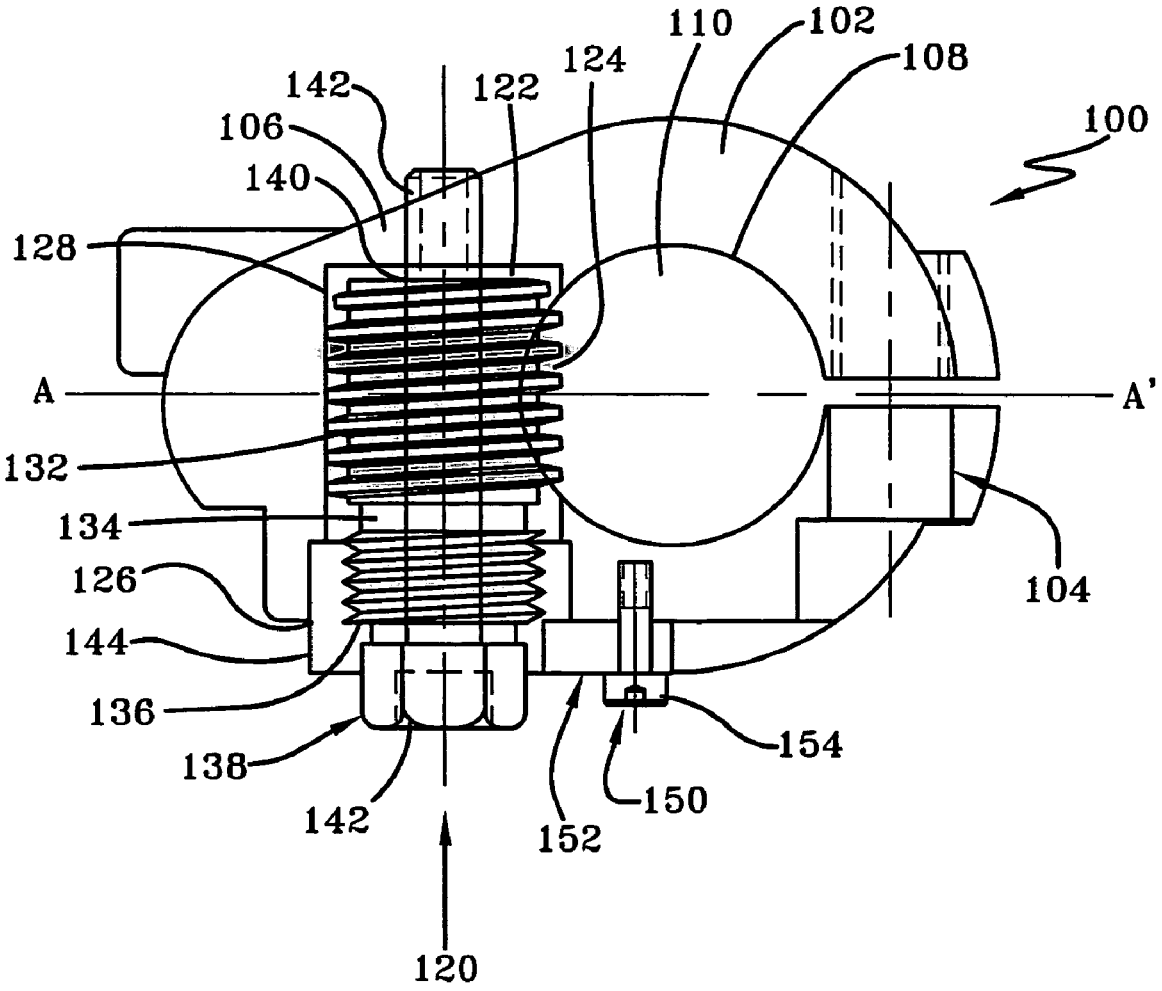
FIG. 2 is a cross sectional view of the seaming lever, from the perspective of A-A' in FIG. 1.

As can be seen in FIG. 2, a seaming lever 100 may include at least two parts, a clamping part 102 and an adjusting part 106. A clamping part 102, may comprise a generally cylindrical passage 108 adapted to hold a shank 110. For purposes of illustration only, in the embodiment shown in FIG. 1 the means of attaching a shank 110 to a seaming lever 100 is a clamping screw 104.

Figure 3:
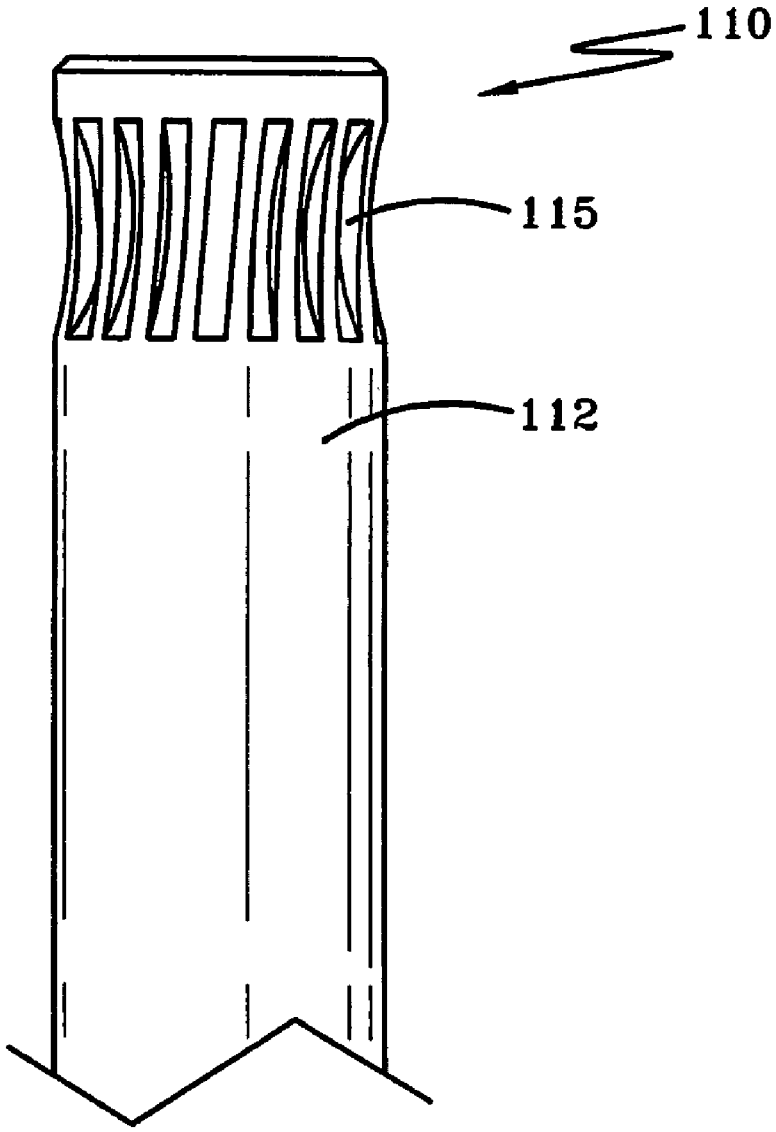
FIG. 3 is a view of the top portion of a shank.
Figure 4:
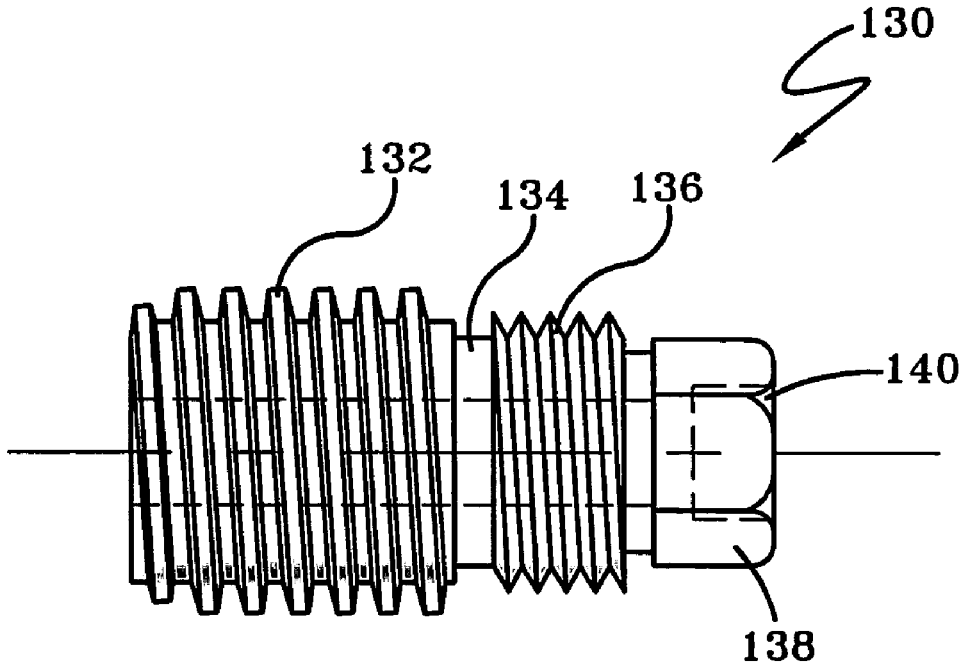
FIG. 4 is a side view of an exemplary embodiment of an adjusting worm.
Figure 11:
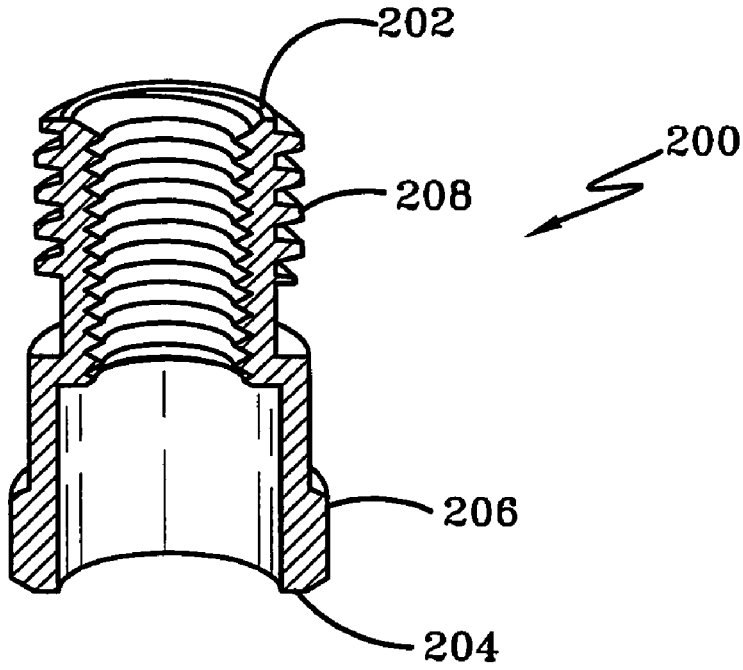
FIG. 11 is a cross sectional view of an internally threaded adjusting worm associated with the alternative exemplary embodiment of a micro adjusting assembly.
Figure 12:
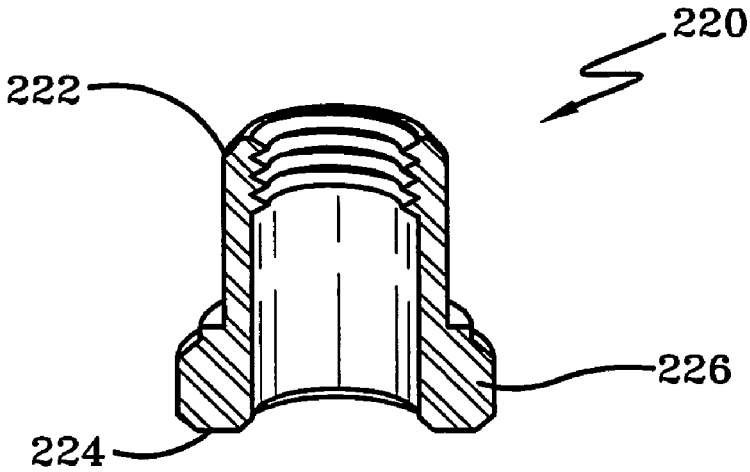
FIG. 12 is a cross sectional side view of a threaded insert associated with the alternative exemplary embodiment of a micro adjusting assembly.

An exemplary embodiment of the shank 110 is shown in FIG. 3. The shank 110 is generally cylindrical with a diameter approximately equal to the diameter of a cylindrical passage 108 in a seaming lever 100 into which the shank 110 is inserted, as can be seen in FIG. 1. The shank 110 has a first end 112 and a second end 114. Formed on the first end 112 of the shank 110, around its circumference, is a worm pinion 115, illustrated in FIG. 3. In the embodiment illustrated, the worm pinion 115 is a worm pinion portion adjacent the first end 112 of the shank 110. In other embodiments, the worm pinion 115 may be a separate axially aligned element. Worm pinion 115 or worm pinion portion, as used herein, include both embodiments. The worm pinion 115 is of appropriate size and shape to be engaged by a worm gear 132 formed on an adjusting worm 130, shown in FIG. 4. The operative engagement of the worm gear 132 and the worm pinion 115 rotates the associated shank 110 about the axis of the shank 110. Exemplary embodiments of adjusting worms 130 and 200 are shown in FIGS. 4 and 11 respectively, and are discussed below. As can be seen in FIG. 1, the second end 114 of the shank 110 may be attached to a seaming roll lever 118. The seaming roll lever 118, in turn, may be attached to a seaming roll 116.

Figure 10:
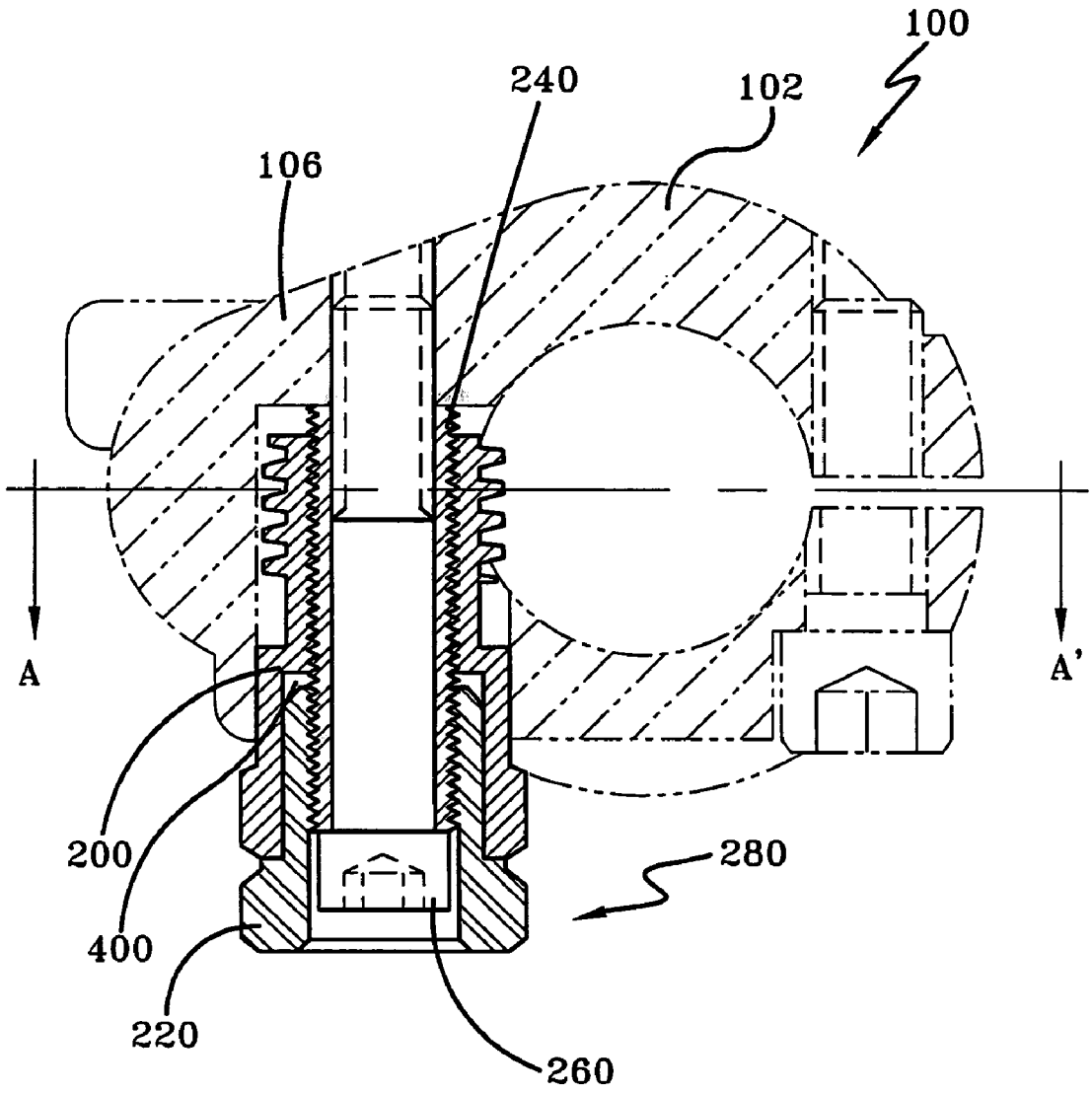
FIG. 10 is a cross sectional view of a seaming lever containing an alternative exemplary embodiment of a micro adjusting assembly, from the perspective of A-A' in FIG. 1.

In an exemplary embodiment which includes the exemplary adjusting worm 130, the adjusting part 106 of the seaming lever 100 comprises an adjusting assembly 120, discussed below. As shown in FIG. 2 the adjusting assembly may fit in a cavity 122 of the a seaming lever 100. An exemplary embodiment of the cavity 122, and the internal structure of an exemplary embodiment, can be seen in detail in FIG. 2. An exemplary cavity 122 may be generally cylindrical and may be stepped. An outer portion 126 of the cavity 122 may have a larger diameter than an inner portion 128. In other exemplary embodiments, the cavity 122 may be of generally uniform diameter, as illustrated in FIG. 10.

The cavity 122 may be sealed on one end, or may be open on both ends. Because of this, the cavity 122 may also be referred to herein as a passage.

The cavity 122 may be generally perpendicular to, and intersects, a generally cylindrical passage 108 into which the shank 110 may be inserted in the seaming lever 100. This intersection creates an opening 124 connecting the cavity 122 and the cylindrical passage 108. In this exemplary embodiment, because the opening 124 is created by the generally perpendicular intersection of two generally cylindrical passages, the opening 124 will be generally circular. In other embodiments, the passages may have different shapes or may intersect at a different angle to create a non-circular opening.

The exemplary adjusting assembly 120 is located in the cavity 122, and may protrude slightly through the opening 124 into the cylindrical passage 108. The adjusting assembly 120 may comprise a coarse adjusting nut 144, an adjusting worm 130, a locking bolt 142, and a keeper assembly 150. An alternative exemplary embodiment of an adjusting assembly 280 is illustrated in FIG. 10, and discussed in more detail below.

Figure 5:
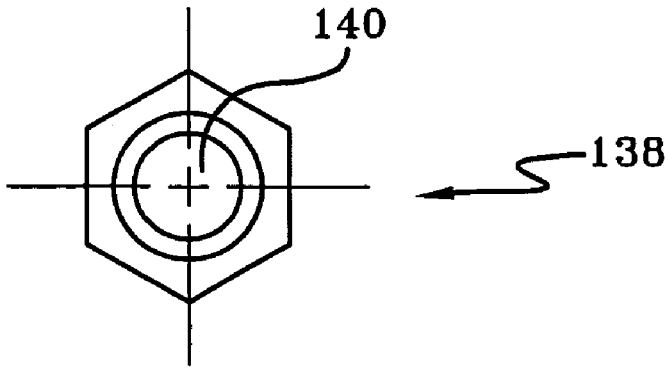
FIG. 5 is a view of a fine adjustment head of the adjusting worm.

The exemplary embodiment of the adjusting worm 130, for use in the exemplary embodiment of the adjusting assembly 120, is shown in more detail in FIGS. 4 and 5. The adjusting worm 130 may comprise three parts, a worm gear 132, a screw 136, and a fine adjustment head 138. Exemplary embodiments may also include a spacing part 134. The structures of the adjusting worm 130 may be formed on a shank, and in an exemplary embodiment may be formed by machining. The exemplary worm gear 132 formed on one end of the adjusting worm 130 may have a diameter approximately equal to the diameter of the inner portion 128 of the cavity 122. The length of the worm gear 132, may be approximately the diameter of the opening 124 between the cavity 122 and the cylindrical passage 108. Adjacent to the worm gear 132, formed on the same shank, may be the spacing part 134. The spacing part 134 may be cylindrical, and may have a diameter that is less than the diameter of the worm gear 132. Although in this exemplary embodiment the length of the worm gear 132 is approximately the same as the diameter of the opening 124, in other embodiments its length may be longer or shorter than the diameter of the opening, as the application requires. Although in this exemplary embodiment, the adjusting worm 130 includes a spacing part 134, other exemplary embodiments may not include a spacing part.

Figure 6:
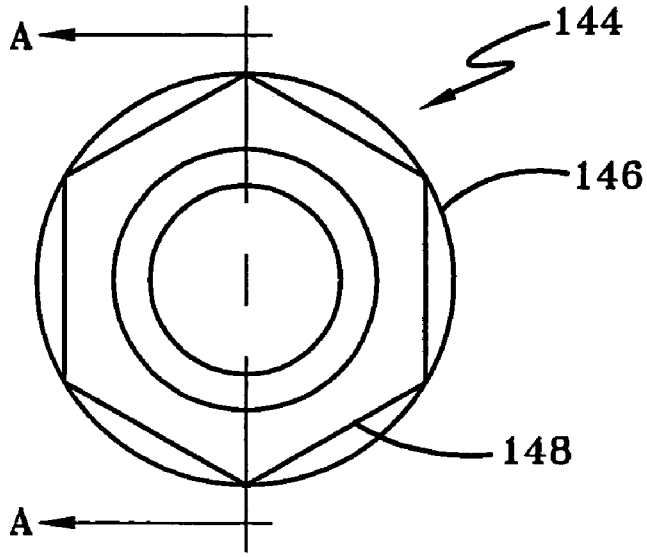
FIG. 6 is an end view of an exemplary embodiment of a coarse adjusting nut.
Figure 7:
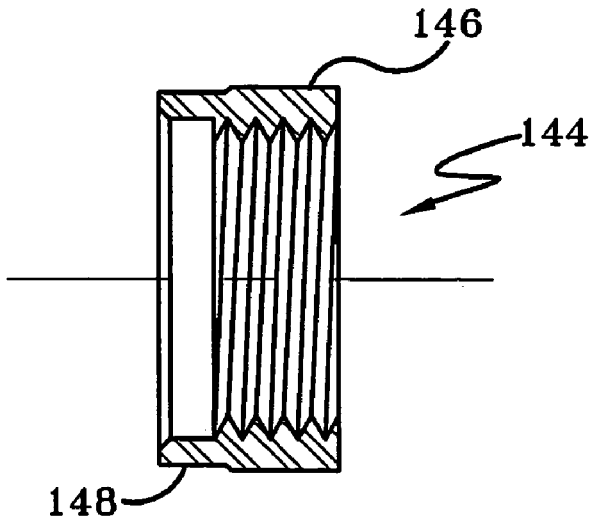
FIG. 7 is a cross sectional view of the coarse adjusting nut from the perspective of A-A' in FIG. 6.
Figure 8:
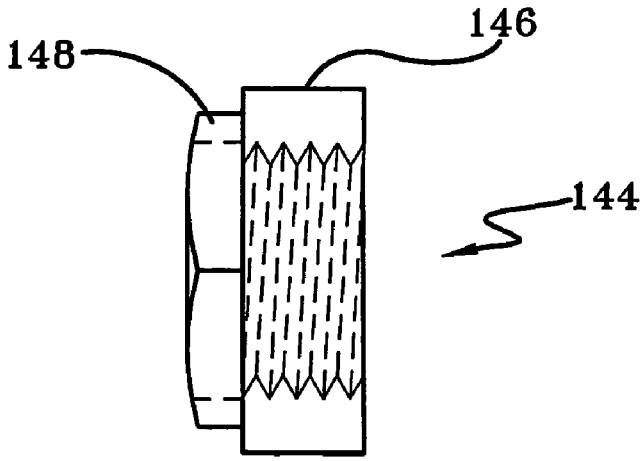
FIG. 8 is a partial cut away side view of the coarse adjusting nut showing the internal threading.

Adjacent the opposite end of the shank of the adjusting worm 130 from the worm gear 132, is a screw 136. The screw 136 has a uniform diameter, and is threaded to match and permit engagement with the internal threading on a coarse adjusting nut 144. The fine adjustment head 138 is formed on the end of the adjusting worm 130 adjacent to the screw 136. The fine adjustment head 138 may be a standard hex head of a size adapted to fit within the first part of coarse adjusting nut 144, which is illustrated in FIGS. 6–8 and discussed below. Although in this exemplary embodiment, the fine adjustment head 138 has a hexagonal shape, in other embodiments it may be of another suitable shape. For example, it may be useful to have the fine adjustment head protrude from the coarse adjusting nut and have a wing shape for easy turning, or may have some other shape which is adapted to permit the user to rotate it within the coarse adjusting nut 144.

Through the axial center of the adjusting worm 130 may be a roughly cylindrical hole 140. The hole 140 may be stepped, and the inner portion of the hole 140 passing approximately from the outer edge of the screw 136 through the worm gear 132 may have a diameter approximately equal to the diameter of a stem of a bolt 142. The remaining outer portion of the hole 140 may have a diameter approximately equal to the diameter of a head of the bolt 142. The bolt 142 is discussed in more detail below. In this exemplary embodiment the adjusting assembly 120 is held in place using the bolt 142 inserted through the adjusting worm 130, and fastened to a threaded hole in the seaming lever 100. In other embodiments the adjusting assembly 120 may be held in place within the cavity 122 by other means.

The pitch of the worm gear 132 generally varies slightly from the pitch of the screw 136. In an exemplary embodiment, the pitch of the worm gear 132 is slightly less than the pitch of the screw 136. Although in this exemplary embodiment, the pitch of the worm gear 132 is slightly less than the pitch of the screw 136, in other embodiments the relationship between the two pitches may be different. For example, the pitch of the worm gear 132 may be slightly more than the pitch of the screw 136 or the difference between the pitches may be too large to be described as slight. In an exemplary embodiment, both the worm gear 132 and the screw 136 are machined with right-handed threads. In other embodiments, either the worm gear 132 or the screw 136, or both may be machined with left-handed threads.

The screw 136 on the adjusting worm 130 is threaded into the coarse adjusting nut 144 (FIG. 2). The coarse adjusting nut 144, illustrated in FIGS. 6–8, is similar to standard nuts known to those skilled in the art. The coarse adjusting nut 144 may comprise two parts. A first part 146 may fit within the cavity 122 in the seaming lever 100 and may have an external shape adapted to permit it to rotate about its axis within the outer portion 126 of the cavity 122. In an exemplary embodiment the external shape of the first part 146 at the coarse adjusting nut is cylindrical. The external diameter of the first part 146 is approximately equal to the diameter of the outer portion 126 of the cavity 122. The internal shape of the first part 146 of the coarse adjusting nut 144 comprises standard threads, with a pitch equal to the pitch of the threads of the screw 136 on the associated adjusting worm 130. A second part 148 of the corresponding nut 146 may have the external shape of a standard hex nut, and is may be adapted to be grasped and rotated. Although in the exemplary embodiment illustrated in FIGS. 6 and 7 the external shape of the second part 148 of the coarse adjusting nut is hexagonal, in other exemplary embodiments it may be shaped differently. The inner shape of the second part 148 is cylindrical, with a diameter that is large enough to permit the fine adjustment head 138 to turn freely within the first part 146 of the coarse adjusting nut 144 when the screw 136 of the adjusting worm 130 is threaded into the first part 146 of the coarse adjusting nut 144. The fine adjustment head 138 may nest within the first part 146 of the coarse adjusting nut 144. The external shapes of an exemplary embodiment of the coarse adjusting nut 144 are illustrated in FIG. 8. The internal shapes are illustrated in FIG. 7.

As shown in FIG. 2, two locking devices, the bolt 142 and the keeper assembly 150, may also comprise part of the adjusting assembly 120. The bolt 142 has a diameter approximately equal to the diameter of the hole 140 through the adjusting worm 130. The head of the bolt 142 is approximately the diameter of the outer portion of the hole 140 in the fine adjustment head 138. The bolt 142 may have a threaded end, opposite the head, the threads of which may cooperate with a threaded hole in the end of the cavity 122 in the seaming lever 100, which may be machined with mating threads. Although in this exemplary embodiment the bolt 142 is used to lock the adjusting assembly 120 within the cavity 122, in other exemplary embodiments other locking devices or means of locking the adjusting assembly within the cavity 122 may be used.

Figure 9:
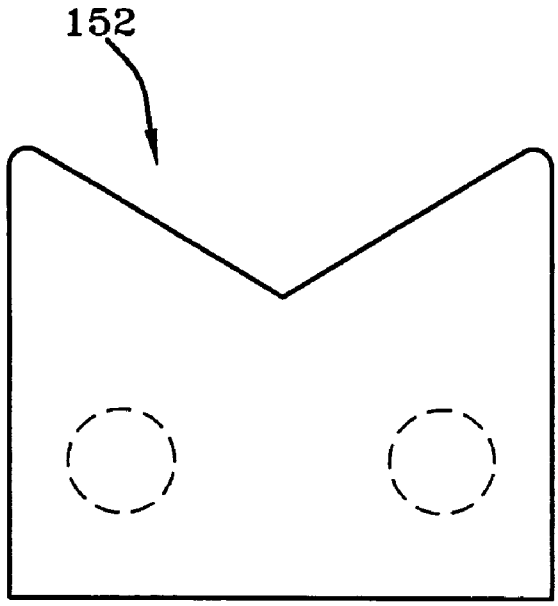
FIG. 9 is a top view of an exemplary embodiment of a keeper.

The keeper assembly 150, may be a further locking device which is operative to lock the coarse adjusting nut 144 in place. The keeper assembly 150 may comprise a keeper 152 and an attachment 154, which are located on the seaming lever 100 adjacent to the coarse adjusting nut 144. In an exemplary embodiment illustrated in FIG. 9, the keeper 152 may include a thin plate with two holes through it and with one edge of the plate shaped to match the external shape of the coarse adjusting nut 144. In other embodiments, the keeper 152 may be configured differently, so long as its shape and position on the seaming lever 100 permit it to lock the coarse adjusting nut 144 into a fixed position once the coarse adjustment has been made.

In the exemplary embodiment illustrated in FIG. 2, the attachment 154 comprises a pair of screws placed through the keeper 152 into threaded holes in the seaming lever 100. In other embodiments, the keeper 152 may be attached in a manner that permits it to lock the coarse adjusting nut 144 into place without the use of tools. For example, a spring may be used to permit the keeper 152 to be lifted above the edge of the coarse adjusting nut 144, so the coarse adjusting nut 144 can be rotated. It might then snap the keeper 152 back when it is released, and may be combined with a spring plunger which snaps into a detent in the surface of the seaming lever 100 to fix the rotational position of the keeper 152 when it is in the locked position. Other suitable embodiments of attachments 154 will be apparent to those skilled in the art.

The exemplary adjusting assembly 120 described above may be manufactured as part of a new seaming lever 100, or may be retrofitted into an existing seaming lever 100. If it is to be used with a seaming lever 100 that is already in use, the seaming lever may require additional machining, such as enlarging the outer portion 126 of the cavity 122 to accept the coarse adjust nut, or removing a portion of the surface to receive the keeper assembly 150.

An exemplary embodiment of the adjusting assembly 280, illustrated in FIGS. 10–14, may generally be used for retrofitting without alteration of the existing seaming lever 100. As can be seen in FIG. 10, an adjusting assembly 280 of this exemplary embodiment comprises an adjusting worm 200, a locking nut 220, a threaded insert 240, and a locking bolt 260. As shown in FIG. 11, the adjusting worm 200 is a hollow member having a worm gear 208 formed on the exterior of a first end 202 of the adjusting worm 200, and a generally cylindrical second end 204. The cylindrical second end 204 has an enlarged rim 206, with a shape adapted to be gripped and held tightly. In the exemplary embodiment illustrated in FIG. 11, the shape of the rim 206 is hexagonal. In other exemplary embodiments, other suitable shapes such as rectangular or octagonal, may be used. The diameter of the worm gear 208, is approximately the same as that of the cylindrical second end 204 of the adjusting worm 200. Both are approximately the same diameter as the cavity 122 into which the adjusting assembly 280 is inserted, and the diameter of the rim 206 is greater than the diameter of the cavity 122. In other embodiments an adjusting assembly 280 may be less uniformly cylindrical, or may use something other than adapted for gripping rim 206 to rotate the adjusting worm.

The interior of the first end 202 of the adjusting worm 200 is threaded. The pitch of the threads on the interior of the first end 202 of the adjusting worm 200 generally varies slightly from the pitch of the threads of the worm gear 208 on the exterior of the first end 202 of the adjusting worm 200, for reasons which are discussed below. The interior of the second end 204 of the adjusting worm 200 may be cupped, with a central hole at a base which connects to a passage through the adjusting worm 200 to the internally threaded second end 202. The second end 204 may be thus adapted to seat the locking nut 220 as shown in FIG. 13.

The locking nut 220 has a first end 222 and a second end 224. The first end 222 of the locking nut 220 is generally cylindrical and hollow and has an exterior diameter approximately equal to the internal diameter of the second end 204 of the adjusting worm 200. The interior of the first end 222 of the locking nut 220 is threaded. When assembled, the locking nut 220 may nest within the second end 204 of the adjusting worm 200. The exterior of the second end 224 of the locking nut 220 is enlarged, and has a lip 226 of sufficient diameter to prevent it from being drawn into the second end 204 of the adjusting worm 200 when the locking nut 220 is nested within the adjusting worm 200. When fully inserted, the lip 226 of the locking nut 220 is locked against the rim 206 of the adjusting worm 200. In this position, which may be seen in FIG. 10, there is a small gap 400 between the first end 222 of the locking nut 220 and the bottom of the cup shaped interior of the second end 204 of the adjusting worm 200. The shape of the lip 226 of the locking nut 220 is adapted to be gripped and held tightly or rotated. In the exemplary embodiment illustrated in FIG. 13, the lip 226 is hexagonal. In other exemplary embodiments the lip 226 may have other suitable shapes.

Figure 13:
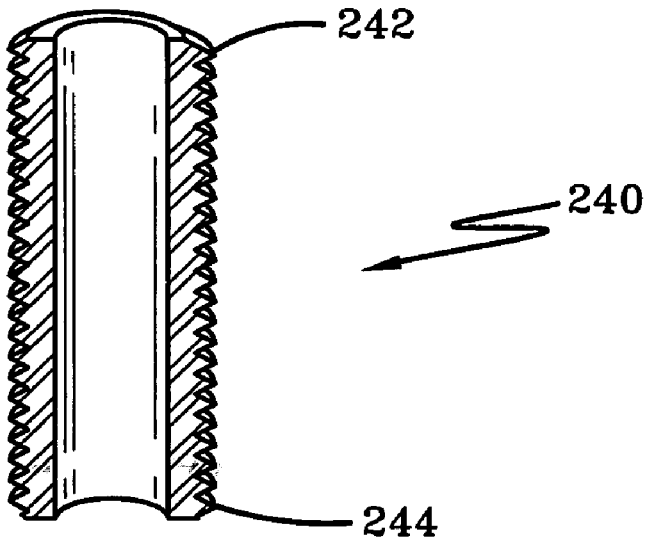
FIG. 13 is a cross sectional side view of a locking nut associated with the alternative second exemplary embodiment of a micro adjusting assembly.

The threaded insert 240, illustrated in FIG. 13, is hollow cylindrical member with external threading on both a first end 242 and a second end 244. The pitch of the external threading on the first end 242 matches the pitch of the internal threading on the first end 202 of the adjusting worm 200. The pitch of the external threading on the second end 244 matches the pitch of the internal threading of the first end 222 of the locking nut 220. The internal diameter of the threaded insert 240 is approximately the same as the external diameter of the locking bolt 260. In this exemplary embodiment the threaded insert 240 is uniform and continuous. In other embodiments, the external threading on the first end 242 may be discrete from and may have a different pitch than the external threading on the second end 244.

Figure 14:
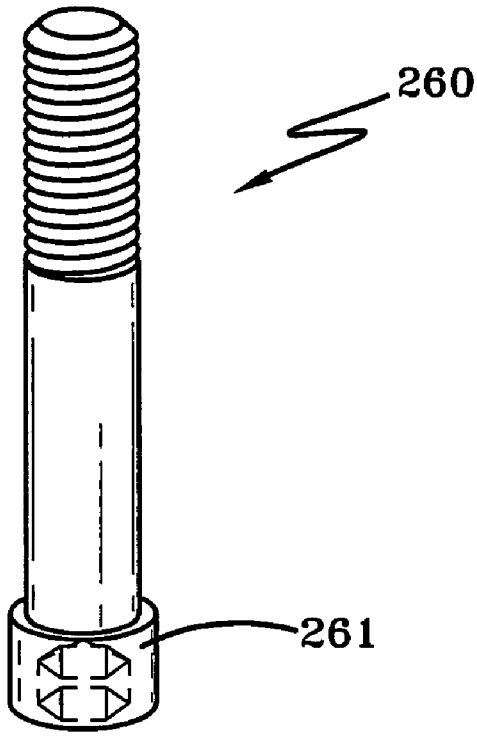
FIG. 14 is a side view of a locking bolt, with a cross-sectional view of the head.

As shown in FIG. 14 the locking bolt 260 may be a standard bolt. In this exemplary embodiment the head 261 of the locking bolt 260 may be a socket head, as can be seen in FIG. 14. The length of an exemplary locking bolt 260 may be sufficient to pass through the threaded insert and screw into the seaming lever 100 to hold the adjusting assembly 280 in place. Although in this exemplary embodiment the adjusting assembly 280 is held in place by a locking bolt 260, in other exemplary embodiments other means may be used to hold the adjusting assembly in place.

When the adjusting assembly 280 is assembled, the first end 242 of the threaded insert 240 is threaded through the internally threaded first end 202 of the adjusting worm 200. The locking nut 220 is threaded around the second end 244 of the threaded insert 240 and nested in the second end 204 of the adjusting worm 200. The adjusting assembly 280 may be held in place by means of a locking bolt 260 which passes through the threaded insert 240 and screws into openings which may be machined into the seaming lever 100. In this exemplary embodiment the adjusting assembly 280 may be held in place using a locking bolt which attaches directly to the seaming lever. In other embodiments different locking devices may be used such as a bolt which passes completely through the seaming lever and engages a separate nut. As with the exemplary embodiment previously described, and as can be seen by a comparison of FIG. 1 with FIG. 10, the threads of the worm gear protrude through the opening 124 and engage the worm pinion 115 on the shank 110, permitting the shank 110 to turn in response to movement of the adjusting worm 200.

An exemplary configuration of a standard seaming lever generally contains a single worm gear for positioning the seaming roll. The worm gear engages and rotates a worm pinion on one end of an associated shank. When the worm pinion is rotated, it rotates the shank, which in turn rotates an attached seaming roll lever about the axis of the shank. Attached to a seaming roll lever is a seaming roll, which must be rotated to a position which is a precise distance from a chuck in order to form a solid seam on a can.

In a traditional seaming lever without a micro adjusting element, there is generally a single fairly coarse adjustment capability. Because of this, adjusting the precise position of the seaming roll is a time consuming task. It generally requires making numerous repeated and imprecise adjustments in order to obtain the correct distance between the seaming roll and a chuck. If the placement is not sufficiently precise, it causes manufacturing waste in the form of improperly sealed cans.

An exemplary embodiment of a seaming lever 100 with micro adjusting capabilities, as further described below, permits easy and precise placement of a seaming roll 116. Methods of using the previously described embodiments of the micro adjusting seaming levers are discussed in detail below.

In the exemplary embodiments illustrated generally in FIGS. 1–9, an initial adjustment is made by rotating the coarse adjusting nut 144, which produces a rotation of the associated pinion that is equivalent to that of a standard worm gear. This initial adjustment is followed by relatively large rotations of the fine adjustment head 138 which produce the functional equivalent of minute rotations of a worm gear 132. This permits the operator to easily and precisely position the associated seaming roll 116 relative to a chuck, using relatively large motions.

Initially, as illustrated in an exemplary manner in FIG. 2, a worm gear 132 is engaged with a worm pinion 115 on the shank 110. A coarse adjusting nut 144 is seated in the outer portion 126 of the cavity 122 in the seaming lever 100. The coarse adjusting nut 144 is fixed in axial position by the cavity 122 and locking bolt 142. Because of this, as the coarse adjusting nut 144 is turned around the screw 136 on the adjusting worm 130, the coarse adjusting nut 144 moves the adjusting worm 130 into or out of the seaming lever 100. Because of the forces associated with the interaction between the worm gear 132 and the worm pinion 115, the adjusting worm 130 does not rotate. The sole motion of worm gear 132 is along its axis, into or out of the seaming lever 100. As it moves, the worm gear 132 acts as a rack, rotating each point on the outer edge of the worm pinion 115 approximately the same distance as the worm gear 132 moves. The motion of a tooth of the worm pinion 115 which is in contact with the worm gear 132 is in the same relative direction as the motion of the worm gear.

In an exemplary embodiment which includes a screw 136 with right-handed threads, rotating the coarse adjusting nut 144 clockwise draws the associated adjusting worm 130 out of the seaming lever 100, without rotating the adjusting worm 130. This movement pulls the worm pinion 115 counterclockwise because a tooth pulled by the worm gear 132 is moved toward the front, in the orientation depicted in FIG. 1, of the seaming lever 100. This movement, in turn, creates counterclockwise rotation of the shank 110, the seaming roll lever 118, and the seaming roll 116 which are attached to it. If the coarse adjusting nut 144 is rotated counterclockwise, the resulting rotation of the seaming roll 116 would be clockwise.

Once the seaming roll 116 is placed in approximately the correct position using the coarse adjusting nut 144, the coarse adjusting nut 144 is locked to prevent any movement. In an exemplary embodiment, this is accomplished by fitting the shaped edge of the keeper 152 around one angle of the coarse adjusting nut 144 and fixing its position using the attachment 154.

The fine adjustment head 138 may then be used to complete the precise positioning of the seaming roll 116. Rotating the fine adjustment head 138 causes two motions to occur. Each motion, alone, would cause the associated worm pinion 115 to rotate. Rotating the fine adjustment head 138, on one end of the adjusting worm 130, rotates the worm gear 132 on the other end of the adjusting worm 130 causing it to act as a traditional worm gear. Each full rotation of the worm gear 132, if it took place in the absence of any other motion of the worm gear 132, would cause the worm pinion 115 to advance or retreat by the single tooth.

In an exemplary embodiment using a right-handed worm gear 132, a clockwise rotation of the worm gear 132 produces counterclockwise motion in the associated shank 110, in the orientation illustrated in FIG. 2.

The rotational motion does not, however, occur without other motion of the adjusting worm 130. Because the coarse adjusting nut 144 is fixed in position, when the fine adjustment head 138 on the adjusting worm 130 is rotated the interaction between the threads of the coarse adjusting nut 144 and the threads of the screw 136 cause the adjusting worm 130 to move along its axis into or out of the seaming lever 100. As a result, the worm gear 132 acts as a rack to turn the worm pinion 115. This movement is identical in magnitude to the movement caused by the initial rotation of the coarse adjusting nut 144, but in the opposite direction.

Thus, in an exemplary embodiment with a right-handed screw 136 and a right-handed adjusting worm 130, the axial motion of the worm gear 132 would cause the associated worm pinion 115 to rotate in one direction and the rotational motion of the worm gear 132 would cause the associated worm pinion 115 to rotate in the opposite direction. Because both axial movement of the worm gear 132 and rotational movement of the worm gear 132 are mechanically combined, and each would independently rotate the associated shank 110, the resulting movement of the associated shank 110 is the sum of the movements each would cause alone. Thus, the magnitude of the resulting worm pinion 115 rotation is equivalent to the difference between the opposite rotations which would be produced independently by the axial and the rotational motions of the worm gear 132. The direction of the worm pinion 115 rotation is the same as the direction of the greater rotation that would have been produced by the independent movement of either the axial or rotational motions of the worm gear 132.

As used in standard seaming levers, and other places, worm gears inherently produce impressive gear reduction. Each rotation of a worm gear advances the associated worm pinion a single tooth, providing an N:1 reduction, where N is the number of teeth on a worm pinion. Previously, increasing the reduction caused by a worm gear for a worm pinion of a fixed diameter has been difficult because it required the use of finer threads, which were closer together in order to increase N. Worm gears which are finely enough threaded to produce the necessary reduction for fine adjustment may be too fine to withstand production rigors. Another alternative is to increase the diameter of the associated worm pinion, however this decreases the ability to use it in relatively small manufacturing settings. In addition, both options require the sacrifice of either the coarse adjustment or the fine adjustment in favor of the other.

Here, as specifically discussed below, the increased reduction in rotation of the worm pinion 115 and the associated shank 110 is dependent only on the difference between the pitch of the screw 136 threads and the pitch of the worm gear 132 threads. Because of this, the ability to make very fine adjustments can be created using a reasonably sized industrial strength worm gear 132 threads, the pitch of which varies minutely from that of similarly sturdy screw 136 threads. An exemplary embodiment of an adjusting assembly 120 as described above is capable of producing reductions several orders of magnitude larger, because each rotation of the fine adjustment head 138 creates the equivalent of a fractional rotation of the worm gear 132.

In an exemplary embodiment of the adjusting assembly 120 as illustrated in FIG. 2, W, S, and N represent the number of teeth per inch on the worm gear 132, the number of teeth per inch on the screw 136, and the number of teeth on the worm pinion 115 respectively. Using a standard worm gear 132 and worm pinion 115, each full rotation of the worm gear 132 moves the associated worm pinion 115 one tooth, or the equivalent of rolling the worm pinion 115 from one thread to the next on a stationary worm gear 132. Because of this, moving a worm gear 132 axially the distance between adjacent threads, or 1/W, creates rotation of the associated worm pinion 115 which is equivalent to that produced by a full rotation of the worm gear 132.

When used as exemplarily described above, the axial motion caused by of each rotation of the coarse adjusting nut 144 is 1/S. This creates an axial motion that is equivalent to W/S rotations of the worm gear 132, making S/W rotations of the coarse adjusting nut 144 equivalent to 1 rotation of the worm gear 132. It takes N rotations of the worm gear 132 to create one rotation of the worm pinion 115, thus it takes N×S/W rotations of the coarse adjusting nut 144 to create one rotation of the worm pinion 115. The reduction associated with the coarse adjusting nut 144, then, is N×S/W:1. Where W and S are approximately the same, this is roughly the equivalent to the N:1 reduction obtained by using the worm gear 132 alone.

As noted above, each rotation of the fine adjustment head 138 causes a rotation of the associated worm pinion 115 which is equivalent in magnitude to the difference between the rotations that would have been caused by each motion independently. A full rotation of the adjusting worm 130 causes a full rotation of the worm gear 132, and rotates the associated worm pinion 115 1/N of a full rotation. A full rotation of the adjusting worm 130 causes an axial movement of 1/S. As noted above, this is equivalent to W/S rotations of the worm gear 132. Absent the rotational motion, the axial motion would rotate the associated pinion W/(N×S) of a full rotation. Because the rotations are in opposite directions, the magnitude of the rotation of the worm pinion which results from a single rotation of the fine adjustment head 138 is (W−S)/(N×S). N rotations of the worm gear 132 would rotate the worm pinion 115 one full rotation, therefore W/S rotations of the worm gear 132 would rotate the worm pinion 115 one tooth, or (W/S)/N of a rotation. Thus, the worm pinion 115 rotation caused by one rotation of the fine adjustment head 138 is (W−S)/(N×S) of a rotation. To produce a single rotation of the worm pinion 115 would thus take (N×S)/(W−S) rotations of the fine adjustment head 138. Thus, the reduction associated with rotating the fine adjustment head 138 is (N×S)/(W×S):1. Where W and S are close, and W is larger than S, S/(W−S) will be larger than one, making (N×S)/(W−S):1 a significantly greater reduction than using a standard worm gear alone.

For purposes of illustration only, and not for purposes of limitation, if W, S, and N are 9, 8, and 30 respectively, it would take approximately 29.7 turns of the coarse adjusting nut 144, moving the adjusting worm 130 axially, to turn the worm pinion 115 a full turn. It would take 240 turns of the fine adjustment head 138, which creates a combination of axial and rotational movement of the worm gear 132, to turn the worm pinion 115 a full turn. This exemplary illustration results in a 240:1 reduction, an 8-fold improvement over using the associated standard worm gear alone.

As seen above, the resulting reduction for any particular adjusting worm 130 combination can be calculated. Because of this, if a specific reduction is desired, appropriate pitches for the incorporated worm gear 132 and screw 136 may be selected which will achieve the desired reduction.

An exemplary embodiment of a adjusting assembly 280 as illustrated in FIGS. 10–14 works similarly. An adjusting assembly 280 comprises a locking nut 220 seated in an adjusting worm 200, with a threaded insert 240 passing through the nested locking nut 220 and adjusting worm 200. Initially, the threaded insert 240 is screwed through the adjusting worm 200 until the first end 242 of the threaded insert 240 extends slightly beyond the first end 202 of the adjusting worm 200. The locking nut 220 is then threaded onto the second end 244 of the threaded insert 240, and nested into the second end 204 of the adjusting worm 200. The locking nut 220 is tightened into the adjusting worm 200 by rotating it around the threaded insert 260 until the lip 226 of the locking nut 240 is locked against the rim 206 of the adjusting worm 200, thus preventing the adjusting worm 200 from moving axially, up or down the threaded insert 240. The locking bolt 260 is then passed through the threaded insert 240 and screwed into the seaming lever 100 tightly enough to fix the adjusting worm 200 axially, but loosely enough to permit the adjusting worm 200 to rotate.

The adjusting worm 200 and the associated worm gear 208 may be rotated by turning the rim 206. The worm gear 208 engages and turns the worm pinion 115 on the shank 110, moving the attached seaming roll 116 toward or away from the chuck. Because of the operation of the worm gear 208 on the worm pinion 115, turning the adjusting worm 200 one full rotation turns the shank 110 one tooth. If the adjusting worm 200 is turned clockwise, the shank 110 will turn counterclockwise. When the seaming roll 116 is in approximately the correct position, the locking nut 220 may be loosened or removed. To accomplish this, the locking bolt 260 is tightened against the threaded insert 240 sufficiently to lock the threaded insert 240 in position between the head 261 of the locking bolt 260 and the seaming lever 100. The lip 226 of the adjusting worm 200 may then held in place while the locking nut 220 is unscrewed around the threaded insert 240. This unlocks the locking nut 220 from the adjusting worm 200. The locking nut 220 may be loosened, or it may be removed completely.

With the locking nut 220 removed or loosened, and the locking bolt 260 holding the threaded insert 240 in position, the adjusting worm 200 is free to move both axially and rotationally. Because of this, when the adjusting worm 200 is turned, it not only rotates about its axis, but also moves along it. As in the exemplary embodiment discussed above, this mechanical combination of the axial and rotational movement of the worm gear 208 can be used to create a much greater rotational reduction than the reduction caused by either axial or rotational motion alone.

In the exemplary embodiment illustrated in FIGS. 10–14, when the locking nut 220 is locked against the adjusting worm 200, one 360° rotation of the adjusting worm 200 turns the associated shank 110 one tooth.

In part, rotating the adjusting worm 200 causes the worm gear 208 to act as a traditional worm gear. Each full rotation of the adjusting worm 200 turns the worm gear 208 a full turn. If the rotation of the worm gear 208 were to take place in the absence of any other motion of the worm gear 208 the rotation would cause the worm pinion 115 to advance or retreat by a single tooth.

In an exemplary embodiment using a right-handed worm gear 208, a clockwise rotation of the worm gear 208 produces counterclockwise motion in the associated shank 110 in the orientation illustrated in FIG. 10.

The rotational motion does not, however, occur without the other motion caused by turning the adjusting worm 200. Because the threaded insert 240 is fixed in position, when the adjusting worm 200 is rotated about the threaded insert the interaction between the internal threads of the adjusting worm 200 and the threads on the threaded insert 240 cause the worm gear 208 on the adjusting worm 200 to move along its axis into or out of the seaming lever 100. The magnitude of this movement, for a full rotation, is equal to the distance between two threads on the threaded insert 240. If the adjusting worm 200 is turned clockwise, it is pulled into the seaming lever 100. In the absence of rotational movement, this would cause a clockwise rotation of the worm pinion 115 and the associated shank 110.

Thus, in an exemplary embodiment with right-handed threading on all screws and worm gears, the axial motion would cause the associated shank 110 to rotate in one direction and the rotational motion would cause the associated shank 110 to rotate in the opposite direction. Because the axial movement of the worm gear 208 and rotational movement of the worm gear 208 are mechanically combined, and each would independently rotate the associated shank 110, the resulting movement of the associated shank 110 is the combination of the movements each would cause alone. Thus, the magnitude of a resulting shank rotation is equivalent to the difference between the opposite rotations which would be independently produced by the axial and the rotational motions of the worm gear 208. The direction of the shank 110 rotation is the same as the direction of the greater rotation that would have been produced by the independent movement of either the axial or rotational motions of the worm gear 208.

For the coarse adjustment in this exemplary embodiment, the adjusting assembly 280 functions as a traditional worm gear, producing an N:1 reduction in rotation in the associated shank 110. For the fine adjustment, the magnitude and direction of motions are identical to those of the exemplary embodiment previously described. Thus the algebraic formula describing the resulting reduction is also applicable here, where S now represents the number of teeth per inch on the internal threads of the adjusting worm 200 rather than the coarse adjusting nut 144. Therefore, the desired reduction for fine adjustment of this exemplary embodiment may be achieved by choosing a suitably small difference between the pitch of the worm gear 206 threads and the pitch of internal threads of the adjusting worm 200.

Seaming levers may also use the mechanical combination of the axial and rotational motion of the adjusting worm for other purposes, as well. As observed, in an exemplary embodiment in which the number of threads per inch on a worm gear is greater than the number of threads per inch on either the coarse adjust nut, or the threaded insert, the seaming roll moves in the same direction for both the fine adjustment as for the coarse adjustment. Although in this exemplary embodiment this relationship may be desirable, in other embodiments it may be desirable to reverse directions for the fine adjustment. This can be accomplished by selecting a worm gear with fewer threads per inch than the number of threads per inch on the associated coarse adjusting nut or threaded insert.

This embodiment will require one or more rotations of the member associated with fine adjustment before any rotation of the associated shank. This is because the fit of a worm pinion to a worm gear must be loose in order to work properly. Because it is loose, a worm gear must rotate from its position against the leading tooth to a position against the trailing tooth before it can push the trailing tooth to reverse direction.

In still other embodiments, it may be useful to configure the adjusting apparatus to increase the rotation of the shank over that of a traditional worm gear, rather than to reduce it. In an exemplary embodiment a screw or threaded insert may be formed with left-handed threads while the worm gear is formed with right-handed threads. In such an embodiment, using the exemplary embodiment illustrated in FIG. 1 for illustration purposes only, when the coarse adjusting nut 144 is rotated clockwise, the adjusting worm 130 is pulled into the seaming lever 100 along its axis a distance of 1/S, where S is the number of threads per inch on the coarse adjusting nut. When the fine adjustment head 138 is rotated clockwise, the adjusting worm 130 moves out of the seaming lever 100 along its axis a distance of 1/S. This acts as a rack on the worm pinion 115, rotating it counterclockwise. In addition, each clockwise rotation of the worm gear 132 is equivalent to an axial movement of 1/W in the same direction, where W is the number of threads per inch on the worm gear 132. Because they are mechanically combined into a single motion, each rotation of the fine adjustment head 138 rotates the shank 110 the axial equivalent 1/W+1/S. Where W and S are close, the effect of rotating the fine adjustment head 138 is to approximately double the rotation of the associated worm pinion 115. The same principles apply to the exemplary embodiment illustrated in FIG. 10.

Although two exemplary embodiments of a micro adjusting seaming lever assembly have been described in detail, other embodiments which produce a coarse adjustment equivalent to the adjustment of a standard worm gear, and a selectable fine adjustment created by the mechanical combination of both axial and rotational movement of a worm gear, will be obvious to those skilled in the art.

Thus, the micro adjusting seaming lever achieves the above stated objectives, eliminates difficulties encountered in the use of prior methods, solves problems and attains the desirable results described herein.

In the foregoing description certain terms have been used for brevity, clarity, and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function and shall not be limited to the structures shown herein or mere equivalents thereof.

Having described the features, discoveries and the principles of the invention, the manner in which it is constructed and operated and the advantages and useful results attained; the new and useful structures, devices elements, arrangements, parts, combinations, systems, equipment, operations, methods and relationships are set forth in the appended claims.

We claim:

1. An apparatus comprising:

a seaming lever, a shank having a first end adapted to rotate axially within the seaming lever, a worm pinion portion adjacent the first end, and a second opposing end operative to connect to a seaming roll, wherein an axial rotation of the shank is operative to move a seaming roll axially around the shank, and a worm gear having an axis, wherein the worm gear is within the seaming lever and is adapted for a first selective motion and a second selective motion, wherein the first selective motion is along the axis and the second selective motion is simultaneously along the axis and around the axis, and wherein the worm gear is in operative connection with the worm pinion portion of the shank to cause an axial rotation of the shank in response to the selective motions of the worm gear.

2. The apparatus of claim 1, wherein the axial rotation of the shank is characterized by an angle of rotation which angle of rotation is further characterized by a size and direction, wherein in the second selective motion the motion of the worm gear about the axis of the worm gear causes the worm gear to function as a traditional worm gear with respect to the worm pinion portion of the shank and, through the operative connection between the worm gear and the worm pinion portion of the shank, creates a first component of the axial rotation of the shank, which first component is characterized by a size and a direction, and the motion of the worm along the axis of the worm gear causes the worm gear to act as a rack with respect to the worm pinion portion of the shank which, through the operative connection between the worm gear and the worm pinion portion of the shank, creates a second component of the axial rotation of the shank, which second component is characterized by a second size and a direction, and wherein the worm gear is further adapted so that the direction of the first component of the axial rotation of the shank is opposite the direction of the second component of axial rotation of the shank, resulting in an angle of rotation of the shank having a size equivalent to the difference between the size of the first component of axial rotation and the size of the second component of axial rotation and the direction of rotation of the shank to be the same as the direction which is associated with the component of axial rotation having the larger size.

3. The apparatus of claim 2 wherein the first selective motion is operative to move a seaming roll approximately to a desired position, and wherein the second selective motion is operative to move a seaming roll more precisely into the desired position.

4. The apparatus of claim 2 wherein the apparatus further comprises:

an adjusting worm, which adjusting worm comprises an elongated cylinder having first and second opposing ends, wherein the adjusting worm includes the worm gear, and wherein the worm gear further comprises a worm gear portion adjacent to the first end of the adjusting worm, wherein the worm gear has threads characterized by a first pitch, and wherein the adjusting worm further includes a screw formed adjacent the second end of the adjusting worm having threads characterized by a second pitch, wherein the apparatus further comprises a coarse adjusting nut having internal threads characterized by the second pitch, wherein the screw of the adjusting worm is in operative threaded connection with the coarse adjusting nut.

5. The apparatus of claim 4 wherein rotation of the coarse adjusting nut about the screw of the adjusting worm creates the first selective motion of the worm gear.

6. The apparatus of claim 4 wherein fixing the coarse adjusting nut in relation to the seaming lever and rotating the screw of the adjusting worm within the coarse adjusting nut creates the second selective motion.

7. The apparatus of claim 1 wherein the first selective motion is operative to move a seaming roll approximately to a desired position, and wherein the second selective motion is operative to move a seaming roll more precisely into the desired position.

8. An apparatus comprising:

a seaming lever, a shank having a first end adapted to rotate axially within the seaming lever, a worm pinion portion adjacent the first end, and a second opposing end is operative to connect to a seaming roll, wherein an axial rotation of the shank is operative to move a seaming roll axially around the shank, and a worm gear having an axis, wherein the worm gear is within the seaming lever and is adapted for a first selective motion and a second selective motion and wherein the first selective motion is around the axis and the second selective motion is simultaneously along the axis and around the axis, and wherein the worm gear is in operative connection with the worm pinion portion of the shank to cause an axial rotation of the shank in response to the selective motions of the worm gear.

9. The apparatus of claim 8 wherein the axial rotation of the shank is characterized by an angle of rotation of the shank which is further characterized by a size and a direction, wherein in the second selective motion the motion of the worm gear about the axis of the worm gear causes the worm gear to function as a traditional worm gear with respect to the worm pinion portion of the shank and, through the operative connection between the worm gear and the worm pinion portion of the shank, creates a first component of the axial rotation of the shank, which first component is characterized by a size and a direction, and the motion of the worm gear along the axis of the worm gear causes the worm gear to act as a rack with respect to the worm pinion portion of the shank which, through the operative connection between the worm gear and the worm pinion portion of the shank, creates a second component of the axial rotation of the shank, which second component is characterized by a size and a direction, and wherein the the worm gear is further adapted so that the direction of the first component of the axial rotation of the shank is opposite the direction of the second component of axial rotation of the shank, resulting in an angle of rotation of the shank having a size equivalent to the difference between the size of the first component of axial rotation and the size of the second component of axial rotation and the direction of rotation of the shank to be the direction which is associated with the component of axial rotation having the larger size.

10. The apparatus of claim 9 wherein the first selective motion is used to move the seaming roll approximately to a desired position, and wherein the second selective motion is used to move the seaming roll more precisely into the desired position.

11. The apparatus of claim 9 wherein the apparatus further comprises:

an adjusting worm which includes the worm gear, which adjusting worm is generally cylindrical and hollow having a stepped interior comprising a narrower portion associated with a first end of the adjusting worm and a wider portion associated with a second opposing end of the adjusting worm, wherein the worm gear comprises a external worm gear portion adjacent to the first end of the adjusting worm, which worm gear has threads characterized by a first pitch, and wherein the first end of the adjusting worm is internally threaded and has threads characterized by a second pitch, a threaded insert which is generally cylindrical and hollow and which has opposing first and second ends and an axis, wherein the threaded insert is externally threaded and has threads characterized by the second pitch and, wherein the threaded insert is adapted to be threaded through the adjusting worm, a locking nut which is adapted to be threaded onto the second end of the threaded insert, which is further adapted to releasably lock the threaded insert to the adjusting worm, a locking bolt having first and second ends wherein the locking bolt is adapted to extend through the threaded insert, and wherein the second end of the locking bolt comprises a head and the first end of the locking bolt is adapted to operatively connect with the seaming lever.

12. The apparatus of claim 11 wherein the rotation of the worm gear about the axis of the threaded insert to which the worm gear is releasably locked creates the first selective motion, wherein a releasably locked relationship between the worm gear and the threaded insert is created by threading the locking nut onto the second end of the threaded insert until it butts against the second end of the adjusting worm, thereby fixing the position of the worm gear relative to the locking nut and threaded insert, and wherein loosely operatively connecting the locking bolt to the seaming lever permits the threaded insert and worm gear to rotate about the axis of the threaded insert without moving along the axis of the threaded insert.

13. The apparatus of claim 11 wherein the second selective motion is created by further tightening the locking bolt, thereby locking the threaded insert between the locking bolt and the seaming lever, and by loosening the locking nut to permit the adjusting worm to rotate about the threaded insert in response to turning the adjusting worm.

14. The apparatus of claim 8 wherein the first selective motion is operative to move a seaming roll approximately to a desired position, and wherein the second selective motion is operative to move a seaming roll more precisely into the desired position.

15. An apparatus comprising:

a seaming lever, wherein the seaming lever includes first and second cylindrical passages, each of which is characterized by a diameter, which passages intersect creating an opening between the passages, a shank with a worm pinion portion on one end, wherein the shank has a diameter which is approximately equal to the diameter of the first passage in the seaming lever, a micro adjusting assembly, wherein the micro adjusting assembly comprises an externally threaded insert which is generally cylindrical and hollow and has first and second ends and an axis, an adjusting worm which is generally cylindrical and has first and second ends, a stepped passage through the adjusting worm, and an exterior, wherein the first end of the adjusting worm is internally threaded, which internal threading is characterized by a pitch, and wherein an internal diameter of the second end of the adjusting worm is greater than an internal diameter of the first end, wherein a worm gear having threads characterized by a pitch is formed on the exterior of the first end and a rim is formed on the exterior of the second end, the exterior of the worm gear is characterized by a diameter that is approximately equal to the diameter of the second passage in the seaming lever, and wherein the pitch of the internal threads is different from the pitch of worm gear threads, and wherein the worm gear engages the worm pinion portion of the shank through the opening between the first and second passage in the seaming lever, and a locking nut which has first and second ends a passage through it, and an exterior, wherein the portion of the passage in the first end of the locking nut is threaded to engage the external threading on the second end of a threaded insert, and wherein the second end of the locking nut is characterized by an external shape that is adapted to nest within the second end of the adjusting worm, and wherein an enlarged lip is formed on the exterior of the second end of the locking nut, and a locking bolt having dimensions adapted to pass through the threaded insert and which locking bolt is further adapted to lock the threaded insert, with respect to motion of the threaded insert in relation to its axis, selectively between motion solely around the axis and no motion.

16. An apparatus comprising:

a seaming lever wherein the seaming lever includes first and second cylindrical passages, each of which is characterized by a diameter, which passages intersect creating an opening between the passages a shank with a worm pinion portion on one end, wherein the worm pinion portion of the shank has a diameter approximately equal to the diameter of the first passage of the seaming lever into which the worm pinion portion of the shank is inserted, a micro adjusting assembly, wherein the micro adjusting assembly comprises an adjusting worm having first and second ends, a passage through adjusting worm, and an axis, wherein the first end of an adjusting worm includes a fine adjustment head adapted to facilitate rotation of the adjusting worm about its axis, a worm gear having threads characterized by a first pitch is formed on the first end of an adjusting worm, wherein the second end of an adjusting worm adjacent the fine adjustment head is threaded having threads characterized by a second pitch, and wherein the first pitch is different from the second pitch, a coarse adjusting nut having internal threading adapted to engage the threading on the second end of the adjusting worm, and having a head which includes an opening of sufficient size to permit the fine adjustment head to rotate within the opening, a keeper assembly adapted to selectively permit motion or no motion of the coarse adjusting nut, a locking bolt having dimensions adapted to extend through the adjusting worm and rotatably hold the micro adjusting assembly within the seaming lever.

17. A method comprising the steps of:

a) providing an apparatus for positioning a seaming roll, the apparatus comprising a seaming lever, a shank, and a microadjusting assembly b) engaging a worm gear of the micro adjusting assembly with a worm pinion portion adjacent a first end of the shank within the seaming lever, the shank having the seaming roll in operative connection with a second end of the shank opposed to the first end, c) locking a first threaded member of the micro adjusting assembly in fixed relation to the seaming lever wherein the first threaded member is axially aligned with the worm gear, and d) rotating a second threaded member with respect to, and in engagement with, the first threaded member, wherein the second threaded member is axially aligned with and fixed in relation to the worm gear, wherein the first and second threaded members have threads characterized by a first pitch, and the worm gear has threads characterized by a second pitch and wherein the first pitch is different from the second pitch.

18. The method of claim 17, further comprising after step ab) rotating a first threaded member in fixed relation to a second threaded member.

19. The method of claim 18, wherein the rotating a first threaded member step occurs before step c).

* * * * *